US008826574B2

(12) United States Patent
Eichner

(10) Patent No.: US 8,826,574 B2
(45) Date of Patent: Sep. 9, 2014

(54) INTERCHANGEABLE DISPLAY SYSTEM

(76) Inventor: Simon Eichner, Johns Creek, GA (US)

( * ) Notice: Subject to any disclaimer, the term of this patent is extended or adjusted under 35 U.S.C. 154(b) by 99 days.

(21) Appl. No.: 13/337,102

(22) Filed: Dec. 24, 2011

(65) Prior Publication Data

US 2012/0159826 A1 Jun. 28, 2012

Related U.S. Application Data

(60) Provisional application No. 61/427,154, filed on Dec. 24, 2010.

(51) Int. Cl.

| | |
|---|---|
| ***A47G 1/06*** | (2006.01) |
| ***E06B 3/72*** | (2006.01) |
| ***G09F 7/18*** | (2006.01) |
| ***E06B 7/30*** | (2006.01) |

(52) U.S. Cl.

CPC ... *G09F 7/18* (2013.01); *E06B 3/72* (2013.01); *E06B 7/30* (2013.01)

USPC ..... 40/781; 40/725; 40/727

(58) Field of Classification Search

USPC ..... 40/781, 725, 727

See application file for complete search history.

(56) References Cited

U.S. PATENT DOCUMENTS

| | | | | |
|---|---|---|---|---|
| 4,006,571 | A | 2/1977 | Bursk | |
| 4,021,967 | A | 5/1977 | Mulder et al. | |
| 4,435,963 | A * | 3/1984 | Shigeru | 63/18 |
| 4,920,771 | A * | 5/1990 | Jiang | 70/4 |
| 5,003,745 | A | 4/1991 | Fang | |
| 5,018,330 | A | 5/1991 | Lewkowitz | |
| D318,128 | S | 7/1991 | Guetle, Jr. | |
| 5,323,579 | A | 6/1994 | Ruff | |
| D349,352 | S | 8/1994 | Csati | |
| 5,414,948 | A * | 5/1995 | Kudo | 40/651 |
| D389,924 | S | 1/1998 | Lint et al. | |
| 5,941,032 | A | 8/1999 | Lydon, Jr. | |
| D417,013 | S | 11/1999 | Gatch | |
| 6,185,883 | B1 | 2/2001 | Howard | |
| 6,224,244 | B1 * | 5/2001 | Burys | 362/489 |
| 6,736,534 | B1 | 5/2004 | Fite | |
| 6,931,810 | B2 | 8/2005 | Beaudoin et al. | |
| 6,948,272 | B1 | 9/2005 | Olivier et al. | |
| 7,320,195 | B1 * | 1/2008 | Kushner | 40/781 |
| 7,343,714 | B2 | 3/2008 | Zocco | |
| 7,383,654 | B2 | 6/2008 | Olivier et al. | |
| 7,490,716 | B2 * | 2/2009 | Pleven | 206/0.8 |
| D610,702 | S | 2/2010 | Lynch et al. | |
| 7,721,501 | B2 | 5/2010 | Lynch et al. | |
| 2003/0041539 | A1 | 3/2003 | Bernacki et al. | |
| 2010/0307105 | A1 * | 12/2010 | Oberbroeckling | 52/784.1 |

* cited by examiner

*Primary Examiner* — Syed A Islam

(74) *Attorney, Agent, or Firm* — Crose Law LLC; Bradley D. Crose

(57) ABSTRACT

An interchangeable display system is disclosed, configured for mounting a display art frame to a door, or the like. The system is adapted to receive interchangeable art inserts, displays, etc., at the will of the proprietor without professional installation. The system provides a proprietor with the capability to customize a door, or the like, with a locking platform mechanism that enhances existing residential and commercial door design configurations. Access is provided to interchangeable art work, for example, without the industry standard to permanently fixate the artwork directly onto or within a door. The system is fixated on one side. The opposing side is, for example, a flanged matching backplate that is locked with a single or multiple sliding and locking hinge mechanism. A perimeter channel is disposed between the front and back frame plates to receive, for example, a translucent decorative art piece, that fits within the channel cavity.

17 Claims, 6 Drawing Sheets

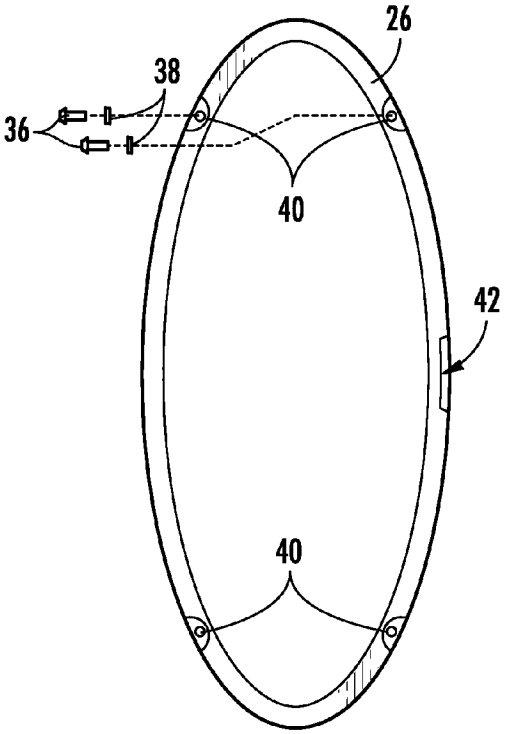
FIG. 3A
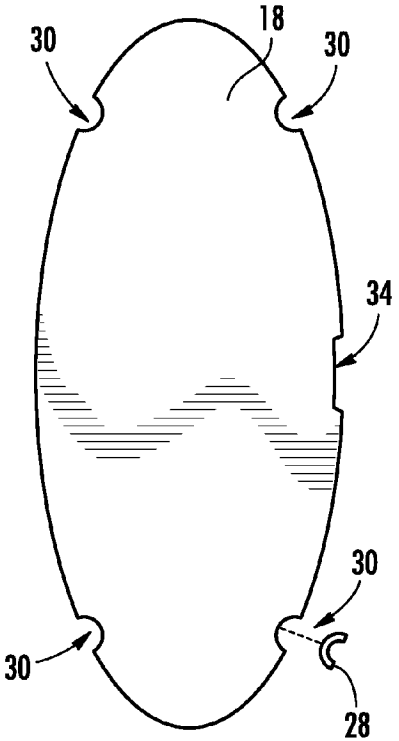
FIG. 3B
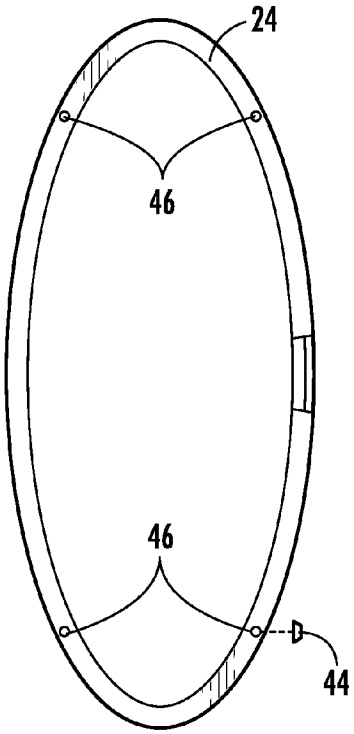
FIG. 3C
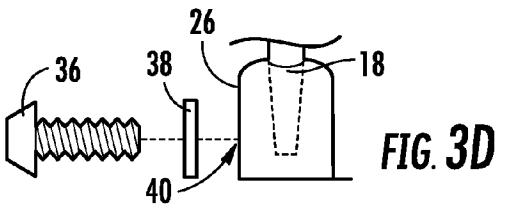
FIG. 3D
FIG. 3E
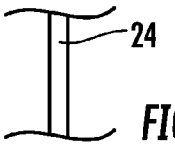
FIG. 3F

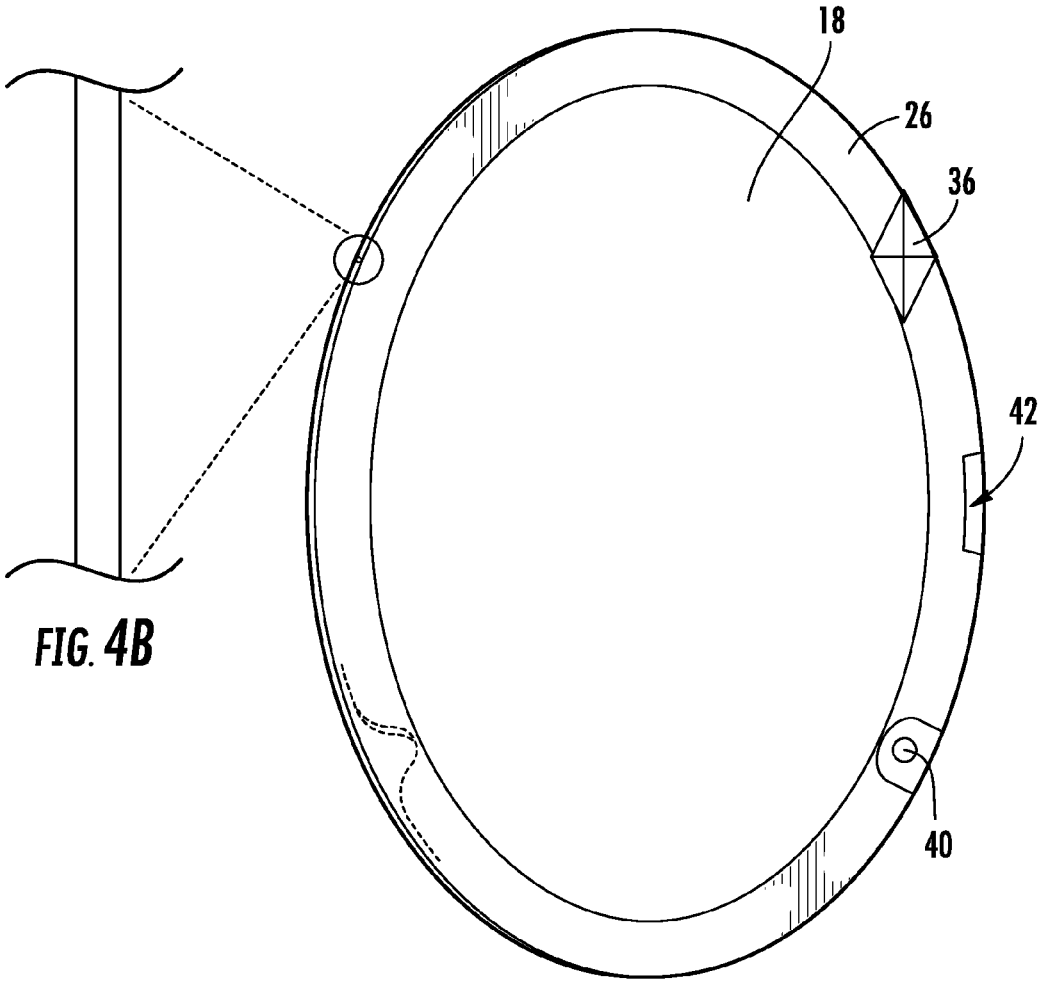
FIG. 4B
FIG. 4A
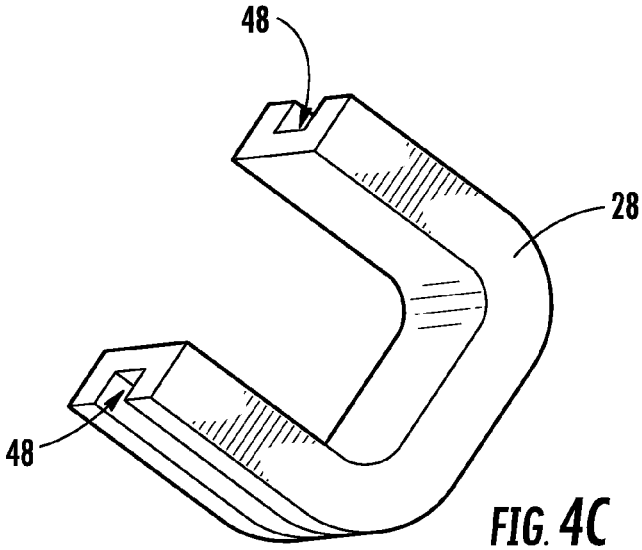
FIG. 4C

INTERCHANGEABLE DISPLAY SYSTEM

CROSS-REFERENCE TO RELATED APPLICATION(S)

The present non-provisional patent application claims the benefit of priority of U.S. Provisional Patent Application No. 61/427,154, which is entitled "INTERCHANGEABLE DISPLAY SYSTEM", which was filed on Dec. 24, 2010, and which is incorporated in full by reference herein.

FIELD OF THE INVENTION

The technology described herein relates generally to the fields of display systems, doors, attachments for doors, and inserts for doors, for both residential and commercial applications. More specifically, the technology relates to an interchangeable display system for mounting a releasable display system to a door, or the like, wherein the interchangeable display system is adapted to receive interchangeable art displays and inserts.

BACKGROUND OF THE INVENTION

Doors, windows, and door lights are well known in the background art. Additionally, door assemblies for mounting panels of glass, iron works, or like materials within a door, window, or the like, have been disclosed and are known in the related background art.

Known systems and methods have many deficiencies and shortcomings. By way of example, door manufacturers produce fixed decorative leaded glass, moldings, carvings, and iron panels on doors. Such fixed installations of doors, including any glass and/or ironworks, or the like, installed with the door, are not accessible or easily interchanged by the consumer. Unless a door is being cut into or repaired by a professional to replace a broken component, there is not an easy way to access and exchange at will a decorative insert by a consumer. Door production has essentially evolved into a low-profit commodity product. By way of example, known door assemblies are configured such that the consumer is prevented from reconfiguration of the door and from replacement for parts or other decorative elements of the door.

Related utility patents known in the background art include the following:

U.S. Pat. No. 4,006,571, issued to Bursk on Feb. 8, 1977, discloses an assembly for mounting a flat panel of glass or other material in an opening in a door frame. The assembly includes complementary molding sections, each of which has inwardly projecting studs which align with the studs on the opposite molding and are secured by tubular clips which slip over the studs. The clips also include outwardly projecting wings which engage the edges of the panel to support and position it in the door frame opening, and at least one of the wings is disposed at approximately 45 degree with respect to a plane bisecting the clip. This construction allows the position of the panel to be adjusted by rotating the clips about their longitudinal axes.

U.S. Pat. No. 4,021,967, issued to Mulder et al. on May 10, 1977, discloses a door light fastener for releasably mounting opposing sections of a door light frame in a door, wherein a plurality of pairs of opposed cylindrical bosses extend inwardly from each of the opposing door light sections, comprises a tubular spring clip that encircles and resiliently holds each pair of bosses together. Inclined barbs in the spring clips permit bosses to be inserted into the ends of the spring clips but inhibit removal of the bosses from the spring clips. A stop projection in each spring clip prevents the bosses from being inserted more than halfway through the spring clip.

U.S. Pat. No. 7,383,654, issued to Olivier et al. on Jun. 10, 2008, discloses an apparatus and method for providing a door handle adapted to receive interchangeable display inserts. The door handle includes a handle body adapted to be coupled to a door of an enclosure. A receiving space is provided within the handle body for exchangeably receiving a display insert. A protective front facing planar member is located at a front face of the door handle and a graphic display is positioned behind the protective front facing planar member. The graphic display is visible through the protective front facing planar member by a person upon approach to the door handle.

U.S. Pat. No. 6,948,272, issued to Olivier et al on Sep. 27, 2005, discloses an apparatus and method for providing a door handle adapted to receive interchangeable display inserts. The door handle includes a handle body adapted to be coupled to a door of an enclosure. A receiving space is provided within the handle body for exchangeably receiving a display insert. A releasable closure mechanism is associated with the receiving space and adapted to be configured between an open configuration in which display inserts may be inserted and removed from the receiving space and a closed configuration in which a display insert is secured within the receiving space. The display insert has at least two substantially planar members that are associated together to fill the receiving space so that they are held substantially stationary when installed therein. A protective front facing planar member is located at a front face of the door handle and a graphic display containing intermediate planar member is positioned behind the protective front facing planar member. The intermediate planar member oriented so that a graphic display of the intermediate planar member is visible through the protective front facing planar member by a person upon approach to the door handle.

U.S. Pat. No. 5,018,330, issued to Lewkowitz on May 28, 1991, discloses a door light for use with a residential or commercial exterior door is disclosed. A plurality of glass holding clips are peripherally spaced about the door opening to position and secure a pane of glass within the door opening. Each clip includes mating interior and exterior members and the members are secured together by threaded fasteners which insert through aligned openings in the clip members. The interior and exterior clip members are provided with at least a pair of spaced projections. Interior and exterior decorative frames peripherally overfit the interior and exterior peripheries of the door opening. The decorative frames are provided with recesses or grooves in alignment with the clip member projections to permit snap-on attachment of the decorative frames over the clip members in a manner to completely shield the clip members and the fasteners. A bottom moisture shield overfits the bottom of the door opening and is provided with flats to receive the bottom clips therein to continuously expel moisture from the door light without interfering with the operation of the clip members.

U.S. Pat. No. 6,736,534, issued to Fite on May 18, 2004, discloses entry doors having transparent insert panels such as etched glass and/or stained glass with tube lights such as 12 mm neon tube lights imbedded in framing along the outer edges of the panels inside the doors. Photo cells can be used to turn on the lights in the dark. Relays can turn on power when the door is closed and spring loaded switches can provide contact between the neon tubes and a transformer before power is supplied.

U.S. Pat. No. 5,941,032, issued to Lydon, Jr. on Apr. 24, 1999, discloses a framing assembly for a door light which includes a first frame, a second frame, and a plurality of channel sections. The first and second frames are formed from a plurality of frame sections. The channel sections are disposed within the hollow space defined by the two skins of a door panel. The first frame sections are attached to the channel sections by any conventional fastening means. The first frame sections are provided with integral latch members and the second frames are provided with integral clip members which cooperate to retain the second frame member within the opening in a hollow door panel without the use of any visible external hardware. The framing assembly of the present invention may be provided with pre-finished surfaces and can be installed in pre-existing doors without the need for special welding equipment or extensive modification to the door panel prior to installation.

U.S. Pat. No. 5,323,579, issued to Ruff on Jun. 28, 1994, discloses a panel light assembly used in panels. The panel light assembly has a retainer clip for a mounting glazing between two opposing frames that are mounted in apertures in the skins of the panel located on either side of the core of the panel. The retaining clip, preferably made of a springy material, includes longitudinally extending legs depending from opposite longitudinal sides of the clip and which are operable to slide over and securingly engage the panel skins. Oppositely spaced and oppositely directed trim retainer prongs project up from said clip body and generally towards a longitudinal center-line of said clip body for engaging the frames and securing the glazing between the frames in the panels light apertures. The present invention provides at least two skin spacer tabs depending from the clip wherein each of the skin spacer tabs is spaced sufficiently apart from legs so as to be able to receive the skins therebetween. The prongs may be bent up projections cut out from said clip body and may further include a trim release means attached to the projections that are tabs further cut out from the clip. The preferred embodiment of the present invention provides skin apertures with embossed edges indented towards the core along the periphery of each of the apertures wherein the embossed edges are essentially parallel to the surface of the skins. The frames are mounted in the apertures within the embossments such that said frames are flush with the outer surfaces of the skins.

U.S. Pat. No. 7,343,714, issued to Zocco on Mar. 18, 2008, discloses a door light including an insert having a substantially planar top surface defining a plane. A raised or projecting portion, at least partially surrounded by the planar surface, includes at least two features extending above the plane of the planar surface. The raised portion has a substantially uniform configuration. The insert may be formed of a substantially shatterproof or impact resistant material. The raised portion may include a bull's-eye pattern or raised concentric rings, which may have one or more truncated sides interrupting at least the outermost concentric ring. The insert may be molded and may be made of plastic, such as acrylic or polycarbonate. The door light may be set within a frame for placement in a door or window, or adjacent the door or window for a side light or transom, on either the exterior or interior of a home.

U.S. Pat. No. 7,721,501, issued to Lynch et al. on May 25, 2010, discloses a door comprising first and second door skins secured to each other to form a cavity therebetween filled with expended foam. Each of the door skins has an opening therethrough for receiving a glass insert and a flange portion. Distal ends of the flange portions of the first and second door skins engage each other in an overlapping relationship by the expansion pressure of the expanded foam. The door further comprises a glazing rim member having a leg portion snap-locked between the flange portions of the first and second door skins. The method for assembling the door comprises the steps of filling the cavity between the door skins with foam material, then inserting the glass insert through the openings in the door skins and mounting the glazing rim member to the first door skin by snap-locking between the flange portions of the first and second door skins.

U.S. Pat. No. 6,931,810, issued to Beaudoin et al. on Aug. 23, 2005, discloses a window framework for mounting a glass pane in an aperture of a panel. The window framework includes an exterior frame having a peripheral wall shaped for fitting with and extending into the aperture. The peripheral wall extends between exterior and interior sides of the panel, and is provided along the periphery thereof with an abutment member adjacent to the exterior side. The wall is also provided with stop means adjacent to the interior side. The window framework also includes removable locking means having a flexible element lockable with the stop means when the locking means is in a locking position. The locking means is also provided with an element for holding the glass pane in position with the aid of the abutment member when the locking means is in the locking position. The window framework further includes a securing means for securing the exterior frame to the panel in the aperture. A method for mounting a glass pane in an aperture of a panel is also provided.

U.S. Pat. No. 5,003,745, issued to Fang on Apr. 2, 1991, discloses a door having a board having opposed depressed portions formed in major opposed side walls and two thermoplastic sheets respectively attached to the major side walls of the board and having depressed portions shaped or embossed with decorative designs, fitted in the depressed portions of the board.

U.S. Pat. No. 6,185,883, issued to Howard on Feb. 13, 2001, discloses a window with decorative accessories for providing a decorative structure while increasing energy efficiency. The window with decorative accessories includes a window frame that has a pair of spaced apart lateral members and upper and lower members extending between the lateral members. Spaced apart first and second panes of glass are mounted in the window frame. A third pane of glass has a plurality of decorative accessories thereon. The third pane is disposed between the first and second panes.

Related design patents known in the background art include the following:

U.S. Pat. No. Des. 389,924, issued to Lint et al. on Jan. 27, 1998, discloses the ornamental design for a doorlite.

U.S. Pat. No. Des. 417,013, issued to Gatch on Nov. 23, 1999, discloses the ornamental design for a set of glass inset panels for a front door and matching sidelight windows.

U.S. Pat. No. Des. 610,702, issued to Lynch et al. on Feb. 23, 2010, discloses the ornamental design for a door facing.

U.S. Pat. No. Des. 318,128, issued to Guetle, Jr. on Jul. 9, 1991, discloses the ornamental design for a decorative glass panel.

U.S. Pat. No. Des. 349,352, issued to Csati on Aug. 2, 1994, discloses the ornamental design for a door insert panel.

Related published patent applications known in the background art include the following:

U.S. Patent Application Publication No. 2003/0041539, filed by Bernacki et al. and published on Mar. 6, 2003, discloses an apparatus, method and system for a window assembly for insertion into an opening in a window supporting structure including, but not limited to, a building wall or door, or a mobile or automotive vehicle. Frame pieces are adapted to fit into opposite sides of the opening and be releasably secured into position without the window glazing or any insert in place. This allows the frame pieces to be installed by one person. The frame pieces are translatable relative to one another over a range to accommodate different thickness openings. A glazing or insert can independently installed in a frame piece. Securing structure can be adapted to accommodate different thickness glazing or inserts.

The foregoing patent information reflects the state of the art of which the inventor is aware and is tendered with a view toward discharging the inventor's acknowledged duty of candor in disclosing information that may be pertinent to the patentability of the technology described herein. It is respectfully stipulated, however, that the foregoing patent and other information do not teach or render obvious, singly or when considered in combination, the inventor's claimed invention.

BRIEF SUMMARY OF THE INVENTION

In various exemplary embodiments, the technology described herein provides an interchangeable display system for releasably attaching and remounting a framing system to, or within, a door, or the like, wherein the interchangeable display system is adapted to receive, for example, but not limited to, interchangeable art inserts and the like.

The interchangeable display system provides a proprietor with the capability to customize a door, window, or the like, with a locking platform mechanism that enhances existing residential and commercial door design configurations. Access is provided for interchangeable decorative art work, for example, without the industry standard to permanently fixate the decorative artwork directly onto or within a door. By way of example, a decorative display can include a translucent art piece of glass or other material. Used in doors and windows, the degree of translucency can vary, to control the amount of light passed through the translucent art piece.

An interchangeable display system, or framing system, is provided having a frame member that on one side is fixated, such as to, or within, a traditional door to a home or other building. The opposing side of the framing system is, by way of example, a flanged matching backplate that is locked with a single, or multiple, sliding and locking hinge mechanisms. A perimeter channel is disposed between the front and back frame plates to receive, for example, a translucent decorative art piece, that fits snuggly within the channel cavity. Retainers such as rubber bumpers, washers, tracks, gaskets, or the like, can be utilized. The Retainers can be weatherproof. The Retainers can be fluorescent, or the like.

In at least one embodiment, the interchangeable display system is enhanced and secured with four wide bolt housings, for example. Each bolt is removable and can include a decorative finial. Each bolt can be hollow to provide storage space for electronics, lights, and so forth. Additionally, security components, or sensors, can be stored within the hollow chambers of the bolt housings. The number of bolt housings can vary to accommodate various sizes of the display system and specific to certain applications of art display.

The interchangeable display system provides interchangeable art display without the need of a professional installer. The interchangeable display system is advantageous over art insert pieces for doors known in the art, in that the door proprietor has control over the interchangeability of the art inserts without the need of a professional door craftsman.

The interchangeable display system provides aesthetic beauty beyond currently available products. A multiplicity of art insert products can be utilized and interchanged within the display system.

The interchangeable display system provides aesthetic beauty with translucent art, or the like, that is interchangeable by the user. The degree of translucency in art chosen can vary, according the proprietor, to control the amount of light passed through the translucent art piece. The art insert can also be lighted by a light emitting device used with the overall system.

The interchangeable display system can be locked once an art insert is placed within, with a coded, lockable hinged platform, for example. The locking hinge mechanism provides security to the display art piece. Decorative display art pieces will vary in value, with many being quite valuable. It is imperative that the display system securely hold such items.

The interchangeable display system can be light-emitting. By way of example, light can be illuminated through the art insert by way of the retainers, channel, framing system, or the like. The color and amount of light can be varied as determined by the proprietor. Single colors of light can be used. Multiple colors of light can be used simultaneously.

The interchangeable display system and its various components can be accessorized with interchangeable accessories. By way of example, the decorative finials utilized with the wide bolt, anchor screw assemblies can be decorative, shaped, translucent, textured, and so forth. The decorative finials can be easily interchanged by the proprietor as well such that the appropriate matching finials are utilized to match the decorative display art piece in use in the display system.

The interchangeable display system can be used for numerous art insert design options for both residential and commercial applications. The display system can be used in or on doors, windows, and so forth. The display system is designed to be interchangeable with new or pre-existing doors and windows.

The interchangeable display system is easily accessible by the proprietor.

The interchangeable display system is easily secured by the proprietor.

In one exemplary embodiment, the technology described herein provides a retainer for a display art piece. The retainer can be a washer having channels to receive the display art piece. The number and size of washers used can vary. A hinged track can also be used as the retainer device to hold the interchangeable display art piece. The retainer can also be a bumper.

In another exemplary embodiment, the technology described herein provides a mounting and framing assembly for removable and interchangeable art insert pieces. The framing assembly can include multiple frame members that are hingedly coupled one to another to allow ease of accessibility to the proprietor when exchanging the art inserts.

In yet another exemplary embodiment, the technology described herein provides a door system adapted for the removable and interchangeable display of art inserts and the like. The system can be manufactured into a door or window assembly such that the proprietor purchases the entire door, window, or the like system as an alternative to retrofitting the display system to an existing door or window system.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the technology described herein. Furthermore, the technology described herein can be useful in other industries.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which:

FIG. 3A is a front view of an exterior frame and associated mounting hardware, according to an embodiment of the technology described herein FIG. 3B is a front view of a display and associated mounting hardware, according to an embodiment of the technology described herein;

FIG. 3C is a front view of an interior frame and associated mounting hardware, according to an embodiment of the technology described herein;

FIG. 3D is a side view of a display, exterior frame, and associated mounting hardware, according to an embodiment of the technology described herein;

FIG. 3E is a side view of a display, according to an embodiment of the technology described herein;

FIG. 3F is a side view of an interior frame, according to an embodiment of the technology described herein;

FIG. 4A is a front view of an interchangeable display system, illustrating, in particular, a hinge mechanism, a decorative screw cap, and a flange nipple, according to an embodiment of the technology described herein;

FIG. 4B is a close-up view of the side of the interchangeable display system, illustrating, in particular, display art between the interior and exterior frame members, according to an embodiment of the technology described herein;

FIG. 4C is a perspective view of a fastener having channels to hold the display art, according to an embodiment of the technology described herein;

DETAILED DESCRIPTION OF THE INVENTION

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides an interchangeable display system for releasably mounting and interchanging a display art frame to a door, or the like. The interchangeable display system is adapted to receive interchangeable art inserts as desired and selected by the proprietor.

Figure 1:
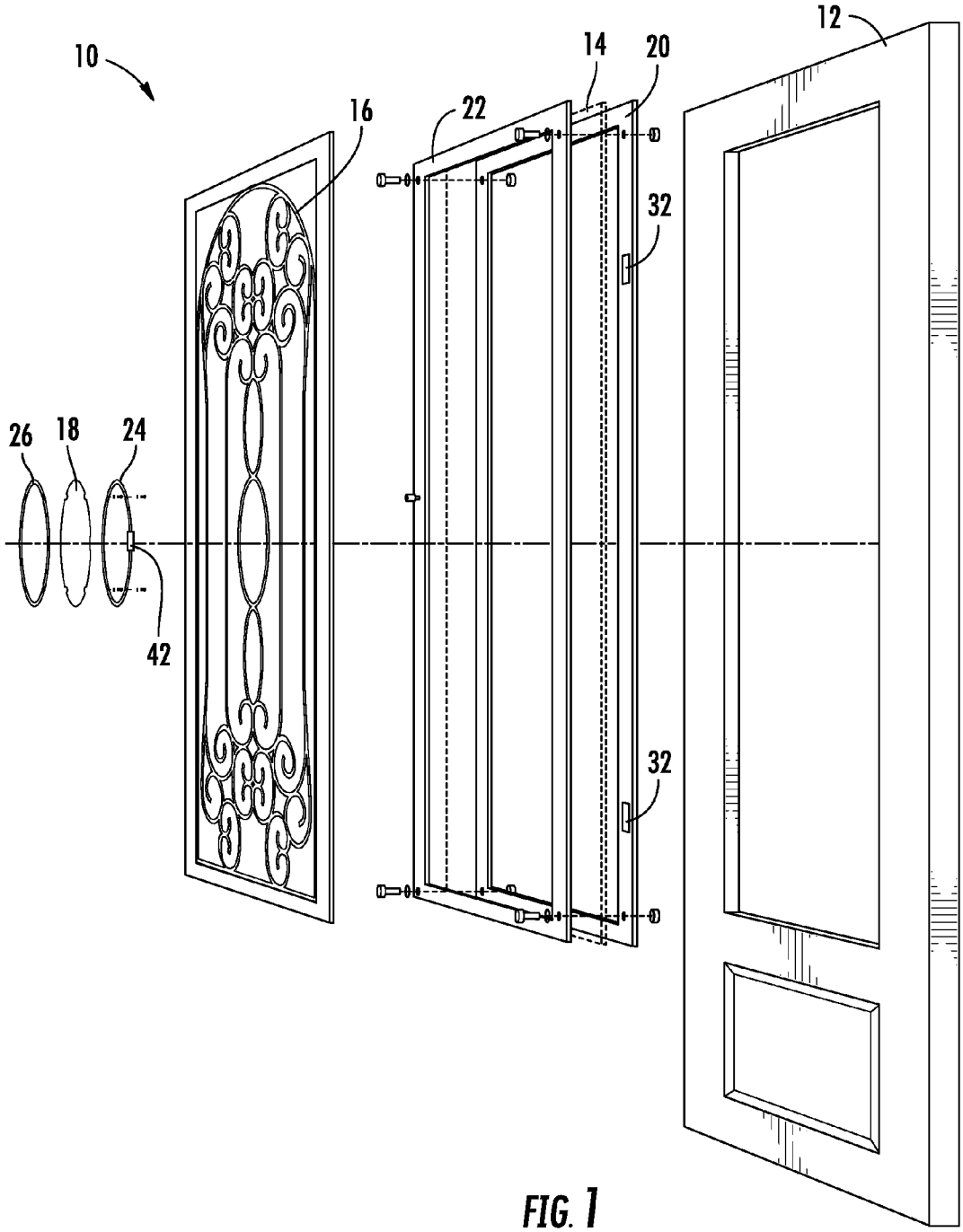
FIG. 1 is a front perspective view of an interchangeable display system, illustrating, in particular, the interchangeable display system utilized upon a door having a decorative art glass and a decorative iron panel, according to an embodiment of the technology described herein.

Referring now to the FIGS. 1 through 8, and in various exemplary embodiments, the technology described herein provides an interchangeable display system 10. The interchangeable display system 10 can be utilized on a multiplicity of items both as an after-market add-on and as an original manufactured product. As depicted in FIG. 1, for example, the interchangeable display system 10 is utilized on a traditional door frame 12. The interchangeable display system 10 works well with both residential and commercial doors, as well as windows, openings, fences, and the like. Furthermore, other buildings and/or structures are suitable to receive and couple with the interchangeable display system 10.

The interchangeable display system 10 can include glass 14, or the like, installed into the door to allow for light to pass. The glass 14 can be secured within the door frame 12 by a variety of means, including, for example, sandwiching the glass 14 between a glass interior frame 20 and a glass exterior frame 22 to securely maintain the glass 14 within the door frame 12. The glass interior frame 20 and the glass exterior frame 22 can be hingedly coupled utilizing a hinge 32.

The interchangeable display system 10 can include one or more iron panels 16. An iron panel 16 can be used on either side of the glass 14, or disposed within the glass 14. Additionally, the location of the display art 18 can vary in relation to its placements on, around, within, and so forth, the glass 14 and the iron panel 16. The use of iron panels 16 is optional.

The interchangeable display system 10 is configured to securely hold and maintain a decorative art insert 18. The art insert 18 can be glass, artificial glass, plastic, metal, wood, and so forth. Additionally, the insert 18 can be a device such as a clock face, video display screen, on so forth that can be mounted within the display system. In at least one embodiment, the art insert 18 is translucent glass. The art insert 18 can vary in shape, size, color, material, and so forth, as selected by the proprietor.

The art insert 18 can be placed between display art interior frame 24 and display art exterior frame 26. The display art interior frame 24 and the display art exterior frame 26 are hingedly coupled one to another, with hinge 42, in at least one embodiment, such that the proprietor can easily open the display art interior frame 24 to remove an existing art insert 18 and insert a replacement art piece. By way of example, a spring loaded hinge mechanism 42 is depicted specifically in FIG. 3A and in FIGS. 8A and 8B.

Figure 8A:
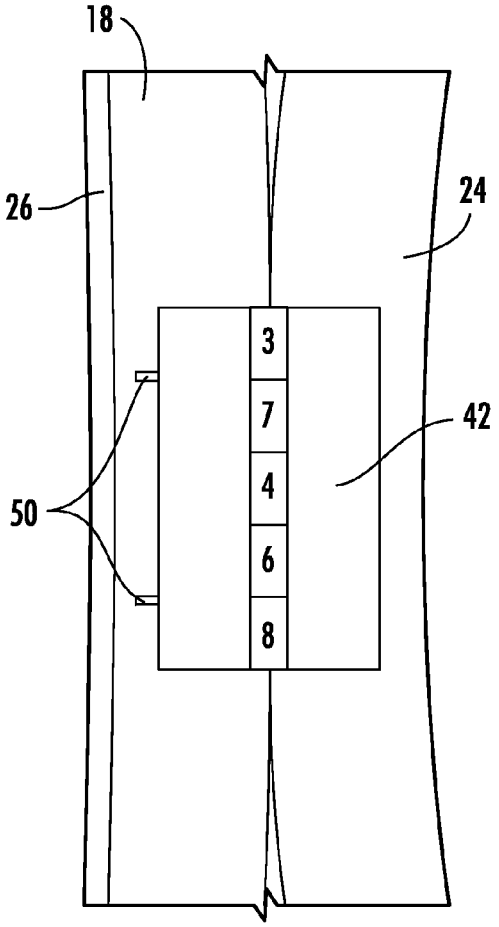
FIG. 8A is a side view of an interchangeable display system, illustrating, in particular, a tumbler locking hinge with side locks and pivots, shown unextended, according to an embodiment of the technology described herein.
Figure 8B:
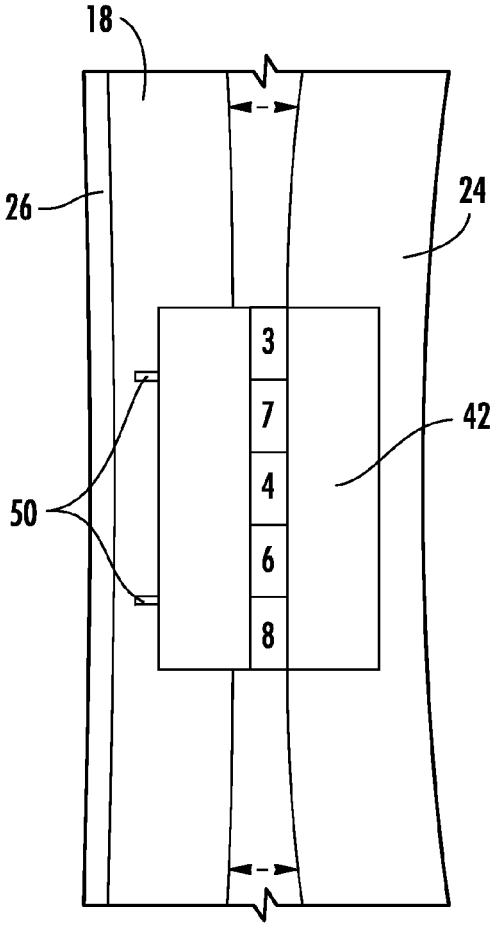
FIG. 8B is a side view of an interchangeable display system, illustrating, in particular, a tumbler locking hinge with side locks and pivots, shown extended, according to an embodiment of the technology described herein.

The spring loaded hinge mechanism 42 can further include, as depicted in FIGS. 8A and 8B, hinge slide/locks 50 by which a user can operatively lock the display system 10 in place once a display art 18 has been inserted. As shown in FIG. 8B, the hinge is partially separated. The hinge can include a numerical locking code to lock and unlock the hinge.

Figure 2:
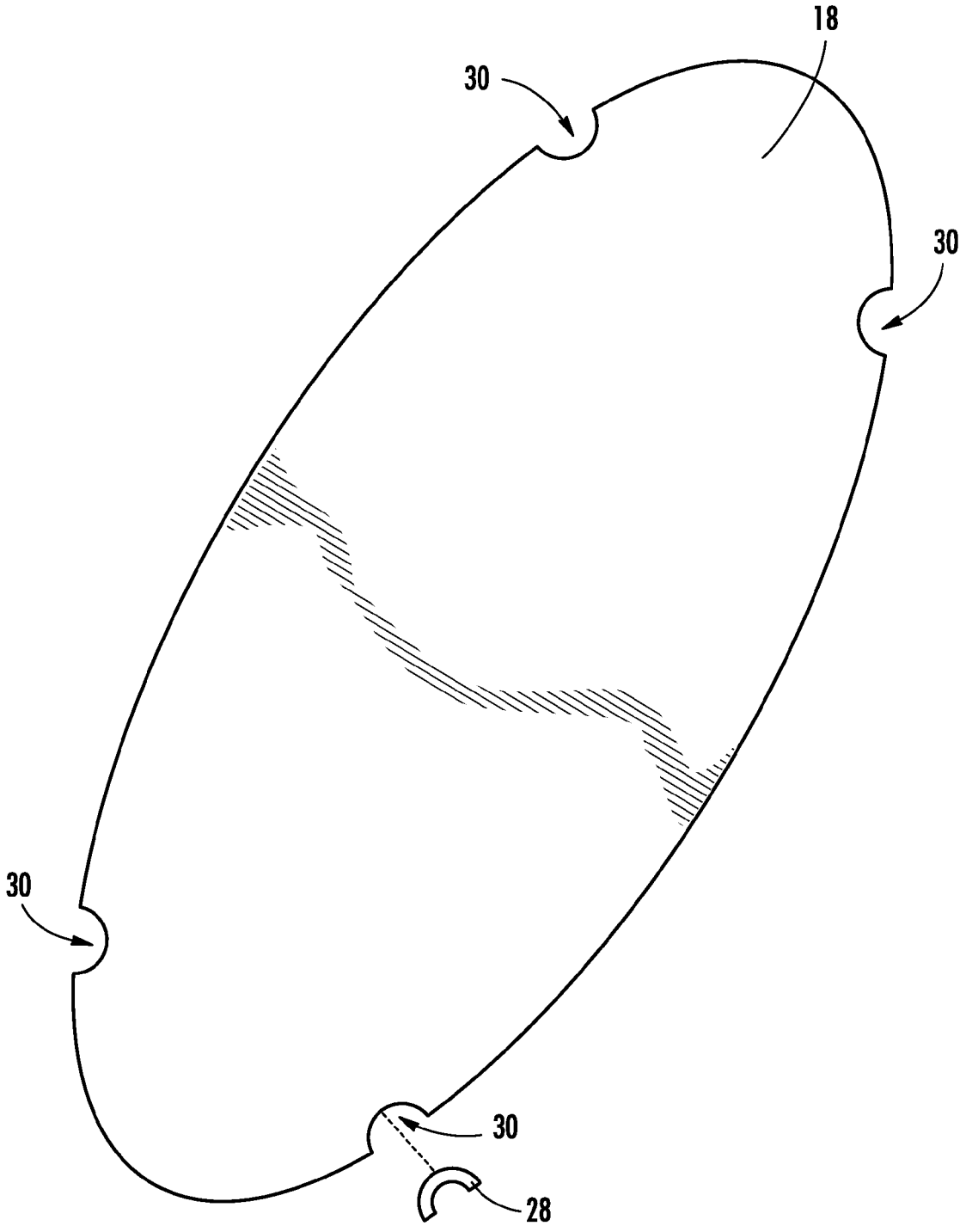
FIG. 2 is a front view of a display and associated mounting hardware, according to an embodiment of the technology described herein.
Figure 5:
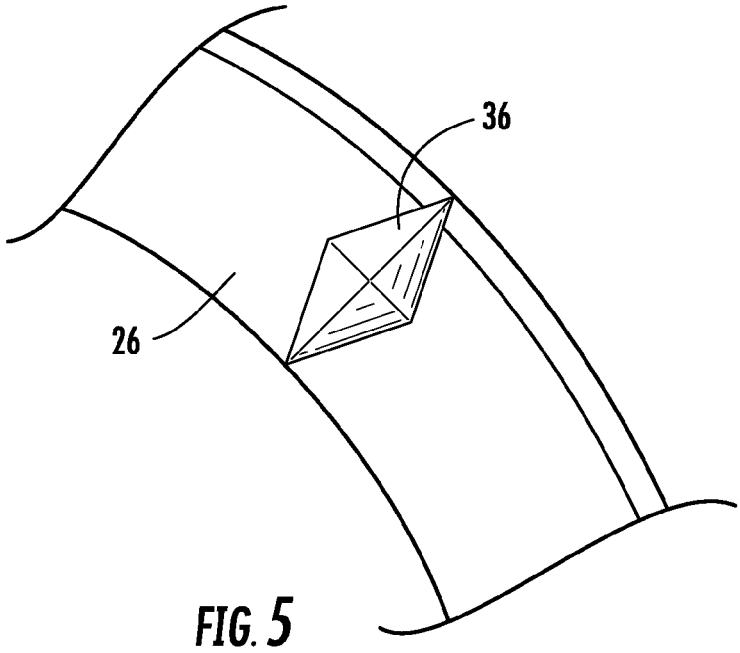
FIG. 5 is a close-up view of a screw with a decorative cap upon the exterior frame, according to an embodiment of the technology described herein.

The display art insert 18 can include multiple grooves 30, or cut-out areas, as depicted specifically in FIG. 2, to accommodate retainers 28. The grooves 30 can vary in location and number. Each groove 30 is adapted to securely receive a retainer 28. The retainer is used to hold the art insert 18 item securely. Additionally, the retainers 28 can be adapted such that no modification, such as grooves 30, is required to the art insert 18 item. Additionally, and as depicted specifically in FIG. 3B, the art insert 18 can include a notch area 34 to allow room for the spring loaded hinge mechanism 42 to operate.

Figure 6:
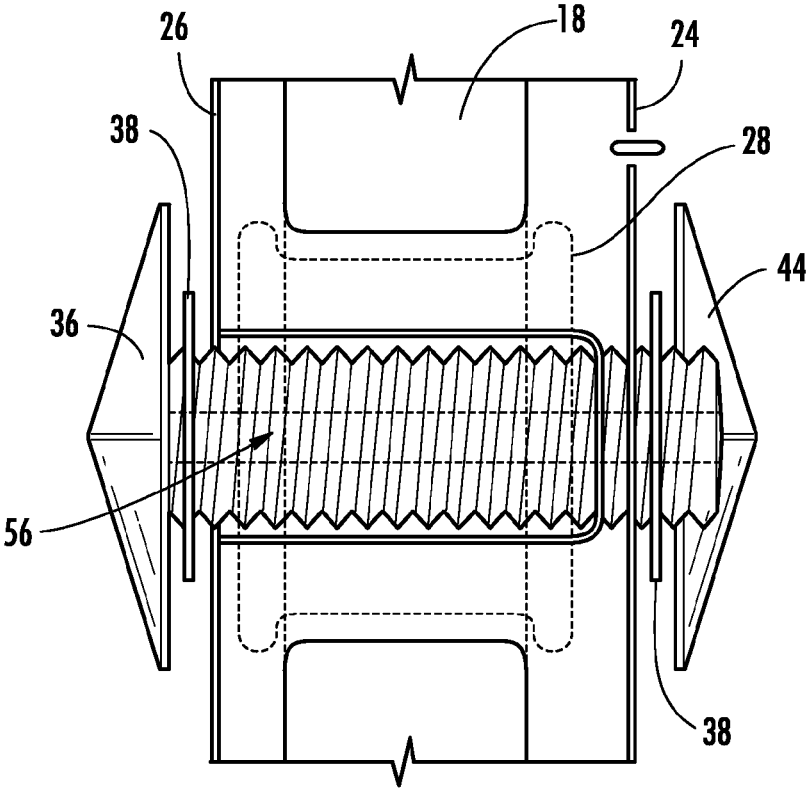
FIG. 6 is a side cross-sectional view of the interchangeable display system, illustrating, in particular, the screw, decorative screw cap, washers, cap nut, and display art fastener with channels utilized to secure the display art, according to an embodiment of the technology described herein.

As depicted in FIGS. 4C and 6, the retainer 28 can include a channel 48. The channel is adapted to receive the art insert 18. By way of example, the retainer 28 can be a half-round nylon washer having a channel 48. In at least one embodiment, the retainer 28 is a single device that fully circumnavigates the perimeter of the art insert 18 and into which the art insert 18 is held and secured.

Mounting hardware can be utilized to secure the display art interior frame 24 and the display art exterior frame 26. As depicted in FIGS. 3A, 3D, 5, and 6, an anchor screw 36 and washer 38 are utilized to insert from the display art exterior frame 26 and into flange nipple 40. The anchor screw 36 enters screw hole 46 on the display art interior frame 24. As depicted in FIG. 3C, a cap nut 44 can be used to secure the display system 10. The cap nut 44 can be a decorative internal cap nut. The cap nut 44 can match the decorative finial on the anchor screw 36.

The anchor screw 36 can include a decorative finial. As depicted in FIG. 4A anchor screw 36 uses a decorative finial resembling a diamond shape. The size, shape, pattern, etc. of the decorative finial can vary. Additionally, the decorative finial can be selected interchangeably to match the display art 14. The anchor screws 36 include a hollow channel 56 in at least one embodiment. The hollow channels 56 are configured to hold security, light, and electronic components.

Figure 7A:
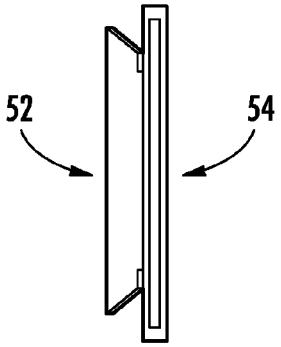
FIG. 7A is a side view of an interchangeable display system having a full iron-hinged glass frame, wherein the glass is framed and hinged to open inwardly and the iron work is welded with the door frame, according to an embodiment of the technology described herein.
Figure 7B:
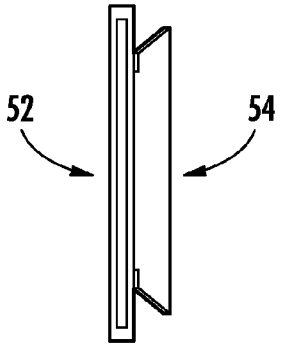
FIG. 7B is a side view of an interchangeable display system having a hinged iron panel, wherein the glass is fixed in the center of the door and the iron work is hinged to swing outwardly, according to an embodiment of the technology described herein.
Figure 7C:
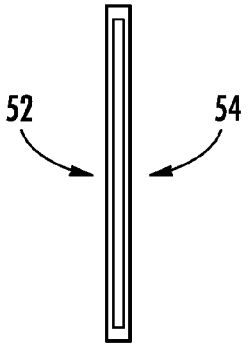
FIG. 7C is a side view of an interchangeable display system having an iron panel sealed in between the glass, wherein the iron unit is fixed with the center of the door, according to an embodiment of the technology described herein.

As depicted in FIGS. 7A, 7B, and 7C, the interchangeable display system 10 can be utilized in a variety of ways. In FIG. 7A, the interchangeable display system 10 has a full iron-hinged glass frame. The glass is framed and hinged to open inwardly (toward inside of door 52) and the iron work is welded with the door frame. In FIG. 7B, the interchangeable display system 10 has a hinged iron panel. The glass is fixed in the center of the door and the iron work is hinged to swing outwardly (from outside of door 54). In FIG. 7C, the interchangeable display system 10 has an iron panel sealed in between the glass. The iron unit is fixed with the center of the door.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the technology described herein and are intended to be covered by the following claims.

What is claimed is:

1. An interchangeable display system adapted to receive interchangeable art displays and inserts, the interchangeable display system comprising:

a spring loaded hinge mechanism;

an interior frame member adapted for selective fixation to and within a traditional door, window, home, or building;

an exterior frame member, wherein the exterior frame member is hingedly coupled to the interior frame member with the hinge, wherein the exterior frame member is configured to selectively pull out from and hingedly open away from the fixed interior frame member and to swing to push close toward the fixed interior frame member, and wherein the interchangeable art display piece is secured between the interior frame member and the exterior frame member;

a perimeter channel cavity defined between the hingedly coupled interior frame member and the exterior frame member and adapted to securely hold within the perimeter channel the display art;

a plurality of housings disposed with the interior frame member and the exterior frame member configured to receive an anchor screw or anchor bolt; and a hollow channel disposed within each of the plurality of housing and configured to hold a security, light, or electronic component.

2. The interchangeable display system of claim 1, wherein the hinge comprises a locking hinge.

3. The interchangeable display system of claim 1, wherein the hinge comprises a spring loaded locking hinge mechanism.

4. The interchangeable display system of claim 1, wherein the hinge comprises a spring loaded locking hinge mechanism, the system further comprising:

a plurality of slide locks; and a numerical locking code by which the plurality of slide locks are configured to be turned to unlock the spring loaded locking hinge mechanism in order to access and replace the display art contained with the interior frame member and the exterior frame member.

5. The interchangeable display system of claim 1, wherein the interior frame member comprises a flanged backplate to receive the exterior frame member when in a closed position.

6. The interchangeable display system of claim 1, further comprising:

at least one retainer adapted for placement within the perimeter channel and configured to securely hold the art display.

7. The interchangeable display system of claim 1, wherein the at least one retainer comprises a retainer channel adapted to receive an edge of the display art.

8. The interchangeable display system of claim 1, wherein the at least one retainer comprises a plurality of bumpers.

9. The interchangeable display system of claim 1, wherein the at least one retainer comprises a plurality of washers.

10. The interchangeable display system of claim 1, wherein the at least one retainer comprises a track.

11. The interchangeable display system of claim 1, wherein the at least one retainer comprises a gasket.

12. The interchangeable display system of claim 1, further comprising:

a plurality of finials, each finial disposed atop one of the plurality of housings.

13. The interchangeable display system of claim 1, wherein each of the plurality of housings further comprises a hollow channel configured to hold a light, and wherein the interchangeable art display piece is illuminated.

14. A combined interchangeable display system and art display piece comprising:

a spring loaded hinge mechanism;

an interchangeable art display piece;

an interior frame member adapted for selective fixation to and within a traditional door, window, home, or building;

an exterior frame member, wherein the exterior frame member is hingedly coupled to the interior frame member with the hinge, wherein the exterior frame member is configured to selectively pull out from and hingedly open away from the fixed interior frame member and to swing to push close toward the fixed interior frame member, and wherein the interchangeable art display piece is secured between the interior frame member and the exterior frame member; and a perimeter channel cavity defined between the hingedly coupled interior frame member and the exterior frame member and adapted to securely hold within the perimeter channel the display art;

a plurality of housings disposed with the interior frame member and the exterior frame member configured to receive an anchor screw or anchor bolt; and a hollow channel disposed within each of the plurality of housing and configured to hold a security, light, or electronic component.

15. The combined interchangeable display system and art display piece of claim 14, wherein the hinge comprises a spring loaded locking hinge mechanism, the system further comprising:

a plurality of slide locks;

a numerical locking code by which the plurality of slide locks are configured to be turned to unlock the spring loaded locking hinge mechanism in order to access and replace the display art contained with the interior frame member and the exterior frame member;

a perimeter channel defined between the hingedly coupled interior frame member and the exterior frame member and adapted to securely hold within the perimeter channel the display art; and at least one retainer adapted for placement within the perimeter channel and configured to securely hold the art display.

16. A combined door and interchangeable display system comprising:

a door configured to receive an interchangeable display system;

a spring loaded hinge mechanism;

an interchangeable art display piece;

an interior frame member adapted for selective fixation to and within a traditional door, window, home, or building;

an exterior frame member, wherein the exterior frame member is hingedly coupled to the interior frame member with the hinge, wherein the exterior frame member is configured to selectively pull out from and hingedly open away from the fixed interior frame member and to swing to push close toward the fixed interior frame member, and wherein the interchangeable art display piece is secured between the interior frame member and the exterior frame member; and a perimeter channel cavity defined between the hingedly coupled interior frame member and the exterior frame member and adapted to securely hold within the perimeter channel the display art;

a plurality of housings disposed with the interior frame member and the exterior frame member configured to receive an anchor screw or anchor bolt; and a hollow channel disposed within each of the plurality of housing and configured to hold a security, light, or electronic component.

17. The combined door and interchangeable display system of claim 16, wherein the hinge comprises a spring loaded locking hinge mechanism, the system further comprising:

a plurality of slide locks;

a numerical locking code by which the plurality of slide locks are configured to be turned to unlock the spring loaded locking hinge mechanism in order to access and replace the display art contained with the interior frame member and the exterior frame member;

a perimeter channel defined between the hingedly coupled interior frame member and the exterior frame member and adapted to securely hold within the perimeter channel the display art and at least one retainer adapted for placement within the perimeter channel and configured to securely hold the art display.

* * * * *